US008079647B2

(12) United States Patent
Yao et al.

(10) Patent No.: US 8,079,647 B2
(45) **Date of Patent: *Dec. 20, 2011**

(54) VIBRATORY MILLING MACHINE HAVING LINEAR RECIPROCATING MOTION

(75) Inventors: Jing James Yao, Mississauga (CA); Robert Eugene Able, Bozeman, MT (US); Thomas J. Oothoudt, Little Falls, MN (US)

(73) Assignee: Longyear TM, Inc., South Jordan, UT (US)

( * ) Notice: Subject to any disclaimer, the term of this patent is extended or adjusted under 35 U.S.C. 154(b) by 396 days.

This patent is subject to a terminal disclaimer.

(21) Appl. No.: 12/233,509

(22) Filed: Sep. 18, 2008

(65) Prior Publication Data

US 2009/0127918 A1 May 21, 2009

Related U.S. Application Data

(63) Continuation-in-part of application No. 11/088,003, filed on Mar. 23, 2005, now Pat. No. 7,434,890.

(51) Int. Cl.
*E21C 25/02* (2006.01)

(52) U.S. Cl. ..... 299/69; 299/14; 299/70

(58) Field of Classification Search ..... 299/14, 299/37.3, 100, 37.1, 69, 70
See application file for complete search history.

(56) References Cited

U.S. PATENT DOCUMENTS

| | | | | |
|---|---|---|---|---|
| 1,964,746 | A | | 7/1934 | Sloan |
| 2,627,849 | A | | 2/1953 | Carlson |
| 2,960,314 | A | | 11/1960 | Bodine, Jr. |
| 2,970,487 | A | | 2/1961 | Ongaro |
| 2,975,846 | A | | 3/1961 | Bodine, Jr. |
| 3,008,528 | A | | 11/1961 | Berthet et al. |
| 3,008,776 | A | | 11/1961 | Love et al. |
| 3,030,715 | A | | 4/1962 | Bodine |
| 3,151,912 | A | * | 10/1964 | Herrmann ..... 299/34.06 |
| 3,217,551 | A | | 11/1965 | Bodine, Jr. |
| 3,224,514 | A | | 12/1965 | Moses et al. |
| 3,268,749 | A | | 8/1966 | Hisashi |
| 3,278,235 | A | | 10/1966 | Bergstrom |
| 3,336,082 | A | * | 8/1967 | Bodine, Jr. ..... 299/14 |
| 3,419,313 | A | * | 12/1968 | Ulusal ..... 299/34.06 |
| 3,466,952 | A | | 9/1969 | Greenberg et al. |
| 3,468,384 | A | | 9/1969 | Bodine |
| 3,477,237 | A | | 11/1969 | Orkney |
| 3,633,683 | A | | 1/1972 | Shatto, Jr. |
| 3,765,723 | A | | 10/1973 | Lobbe et al. |

(Continued)

FOREIGN PATENT DOCUMENTS

CA 2602094 8/2009

(Continued)

OTHER PUBLICATIONS

U.S. Appl. No. 12/242,047, mail date Nov. 17, 2009, Restriction Requirement.

(Continued)

*Primary Examiner* — John Kreck
(74) *Attorney, Agent, or Firm* — Workman Nydegger

(57) ABSTRACT

A continuous mining method includes operating a vibratory milling machine having a milling head, a base, and a milling tool to oscillate the milling head in a substantially linear reciprocating fashion relative to the base to move the milling tool along a milling axis; and advancing the vibratory milling machine in a work piece in a cutting direction and wherein milling axis is oriented at an attack angle relative to the cutting direction, the attack angle being between about 0 and about 40 degrees.

20 Claims, 13 Drawing Sheets

U.S. PATENT DOCUMENTS

| | | | | |
|---|---|---|---|---|
| 3,868,145 | A | 2/1975 | Cobb et al. | |
| 3,922,017 | A | 11/1975 | Cobb | |
| 4,227,744 | A | 10/1980 | Livesay | |
| 4,247,149 | A | 1/1981 | Livesay | |
| 4,265,129 | A | 5/1981 | Bodine | |
| 4,318,446 | A | 3/1982 | Livesay | |
| 4,515,408 | A | 5/1985 | Gurries | |
| 4,603,748 | A | 8/1986 | Rossfelder et al. | |
| 4,615,400 | A | 10/1986 | Bodine | |
| 4,616,716 | A | 10/1986 | Bouplon | |
| 4,736,987 | A | 4/1988 | Lenzen et al. | |
| 5,027,908 | A | 7/1991 | Roussy | |
| 5,086,854 | A | 2/1992 | Roussy | |
| 5,103,705 | A | 4/1992 | Bechem | |
| 5,190,353 | A | 3/1993 | Bechem | |
| 5,355,964 | A | 10/1994 | White | |
| 5,409,070 | A | 4/1995 | Roussy | |
| 5,562,169 | A | 10/1996 | Barrow | |
| 5,588,418 | A | 12/1996 | Holmes et al. | |
| 6,033,031 | A | 3/2000 | Campbell | |
| 6,139,477 | A | 10/2000 | Bechem et al. | |
| 6,183,170 | B1 | 2/2001 | Wald et al. | |
| 6,561,590 | B2 | 5/2003 | Sugden | |
| 6,623,084 | B1 | 9/2003 | Wasyleczko | |
| 7,434,890 | B2 * | 10/2008 | Yao et al. | 299/14 |

FOREIGN PATENT DOCUMENTS

| | | | |
|---|---|---|---|
| DE | 19921701 | A1 | 2/2000 |
| EP | 06705307.4-1262 | | 7/2009 |
| WO | WO 00/43637 | | 7/2000 |
| WO | WO 00/46486 | | 8/2000 |

OTHER PUBLICATIONS

Issue Notification dated Oct. 20, 2010 from U.S. Appl. No. 12/242,047, filed Nov. 9, 2010 (1 page).

U.S. Appl. No. 11/088,088, mail date Jan. 24, 2007, Office Action.

Office Action dated Nov. 17, 2009 from U.S. Appl. No. 12/242,047, filed Sep. 30, 2008 (6 pages).

Office Action dated Apr. 14, 2010 from U.S. Appl. No. 12/242,047, filed Sep. 30, 2008 (15 pages).

Notice of Allowance dated Sep. 1, 2010 from U.S. Appl. No. 12/242,047, filed Sep. 30, 2008 (6 pages).

Office Action dated Nov. 20, 2007 from U.S. Appl. No. 11/088,003, filed Mar. 23, 2005 (13 pages).

Notice of Allowance dated Jul. 11, 2008 from U.S. Appl. No. 11/088,003, filed Mar. 23, 2005 (6 pages).

Supplemental Notice of Allowability dated Aug. 25, 2008 from U.S. Appl. No. 11/088,003, filed Mar. 23, 2005 (2 pages).

Issue Notification dated Sep. 24, 2008 from U.S. Appl. No. 11/088,003, filed Mar. 23, 2005 (1 page).

Office Action dated Feb. 1, 2011 from U.S. Appl. No. 12/910,675, filed Oct. 22, 2010 (8 pages).

Office Action dated May 4, 2011 3, 2011 from U.S. Appl. No. 12/910,675, filed Oct. 22, 2010 (8 pages).

U.S. Appl. No. 12/242,047, filed Sep. 30, 2008, Jing James Yao.

Notice of Allowance dated Aug. 25, 2011 from U.S. Appl. No. 12/910,675, filed Oct. 22, 2010 (5 pages).

* cited by examiner

VIBRATORY MILLING MACHINE HAVING LINEAR RECIPROCATING MOTION

RELATED APPLICATIONS

This application is a continuation-in-part of U.S. patent application Ser. No. 11/088,003, filed Mar. 23, 2005, the entire disclosure of which is incorporated herein by reference.

BACKGROUND OF THE INVENTION

1. The Field of the Invention

This application relates to milling equipment and methods for using such equipment in mining and construction operations. In particular, this application relates to a vibratory milling machine for removing materials in a substantially linear reciprocating motion to continuously remove the materials.

2. The Relevant Technology

Processes for removing materials, such as rock and hard materials, are often used in both the construction and mining industries. One common removal technique often used in mining involves drilling into and blasting a section of material with explosives and then mechanically removing the blasted material. The blasting and removal process is repeated until the desired amount of material is removed. This process can be time consuming, costly, very dangerous, and inappropriate for certain locations. Often, ground supports have to be used for safety reasons in drill and blast operations, i.e., to prevent collapsing.

Other types of machines have been proposed to mine materials that increase productivity and reduce labor costs. One type of machine that has been used is a roadheader. Roadheaders contain a boom-mounted cutting head, a loading device usually involving a conveyor, and a crawler traveling track to move the entire machine forward into the rock face. But often roadheaders are limited to being used with soft rock.

Another type of machine uses oscillation in combination with other motions, such as in a rotating mining tool, to cut rock with less energy than otherwise would be required. Attempts to produce a machine using these concepts have met with limited success, however, due to the destructive nature of the oscillation forces. Some other machines, such as tunnel boring machines (TBM), use a variety of rotating implements to cut and break the material for removal. However, the rotating implements require a high amount of maintenance and are slow compared to blasting and removal techniques. Additionally, TBMs are not suitable for mining because they are not able to be easily redirected or moved from one section of a mine to another.

The subject matter claimed herein is not limited to embodiments that solve any disadvantages or that operate only in environments such as those described above. Rather, this background is only provided to illustrate one exemplary technology area where some embodiments described herein may be practiced

BRIEF SUMMARY OF THE INVENTION

A continuous mining method includes operating a vibratory milling machine having a milling head, a base, and a milling tool to oscillate the milling head in a substantially linear reciprocating fashion relative to the base to move the milling tool along a milling axis; and advancing the vibratory milling machine in a work piece in a cutting direction and wherein milling axis is oriented at an attack angle relative to the cutting direction, the attack angle being between about 0 and about 40 degrees.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which:

FIG. 1 is an isometric view of a vibratory milling machine mounted to a support arm;

Figure 1:
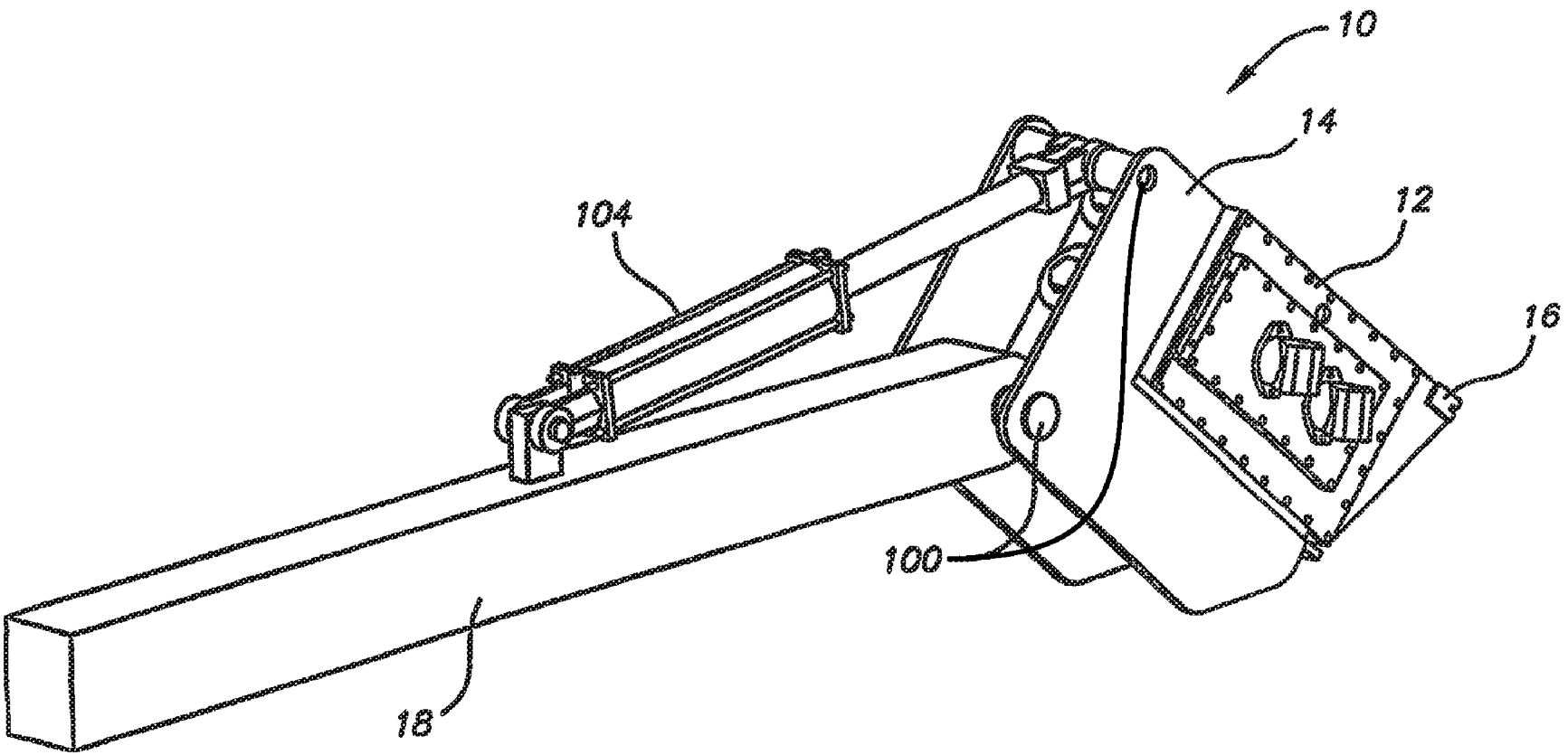
FIG. 1 illustrates

Together with the following description, the Figs. demonstrate non-limiting features of exemplary devices and methods. The thickness and configuration of components can be exaggerated in the Figures for clarity. The same reference numerals in different drawings represent similar, though not necessarily identical, elements.

DETAILED DESCRIPTION OF THE PREFERRED EMBODIMENTS

The following description supplies specific details in order to provide a thorough understanding. Nevertheless, the skilled artisan would understand that the milling machine and methods of making and using the machine can be implemented and used without employing these specific details. Indeed, the milling machines and associated methods can be modified and used in conjunction with any apparatus, systems, components, and/or techniques conventionally used in the mining or construction industries. Additionally, while the description below focuses on implementing the milling machines and milling in horizontal and vertical directions, it could be implemented for milling in any desired direction.

Some embodiments of the vibratory milling machines are illustrated in FIGS. 1-4. In these Figures, a vibratory milling machine 10 has a milling head 12 that oscillates in a substantially linear reciprocating fashion relative to a base 14 to drive a milling tool 16 against a material that is desired to be removed. In some configurations, a single milling machine can contain multiple milling heads 12 and/or multiple milling tools 16.

The vibratory milling machine 10 can be used to remove a wide range of materials. The materials can be natural materials like rock formations or mineral deposits. As well, the materials can be synthetic materials, such as asphalt or concrete. As well, the materials could be a material or a hard workpiece in connection with a construction project, i.e., such as might be encountered in building demolition.

As illustrated in the Figures, the milling tool(s) can be carried by or on the housing of the milling machine. In other embodiments, the milling tool can be mounted on an extension of the housing. Such a configuration improves access to a work piece, such as in restricted areas or where the work piece is elevated (i.e., in scaling mine faces).

The vibratory milling machine 10, and thus the milling tool 16, may be moved by a support arm 18 of any known equipment that provides the desired support for the milling machine 10, including a backhoe, hydraulic excavator or other piece of excavating equipment that carries the milling machine. As well, support arm 18 may be a member of a conventional boom milling machine, or any other milling machine such as roadheaders, boom miners, tunnel boring machines (TBMs), bulldozers, boomtrucks, etc. The support arm may be part of the known equipment or could be added to equipment and, therefore, the milling machine can be adapted to a wide variety of equipment. While a single edged milling tool 16 is illustrated, it will be appreciated that multi-edged tools can be provided that oscillate substantially parallel to a milling axis.

Vibratory milling machine 10 may be attached to support arm 18 through any known connection points 100. A hydraulic actuator 104 may be attached to one of connection points 100 and support arm 18 to allow manipulation of vibratory milling machine 10. Connection points 100 may be located on any portion and in any orientation of vibratory milling machine 10 to allow different attack angles and to maximize any intended mining operations. In some embodiments, support arm 18 may be telescoping to allow effective manipulation of vibratory milling machine 10 to allow for continuous cuts on a plane.

Figure 2:
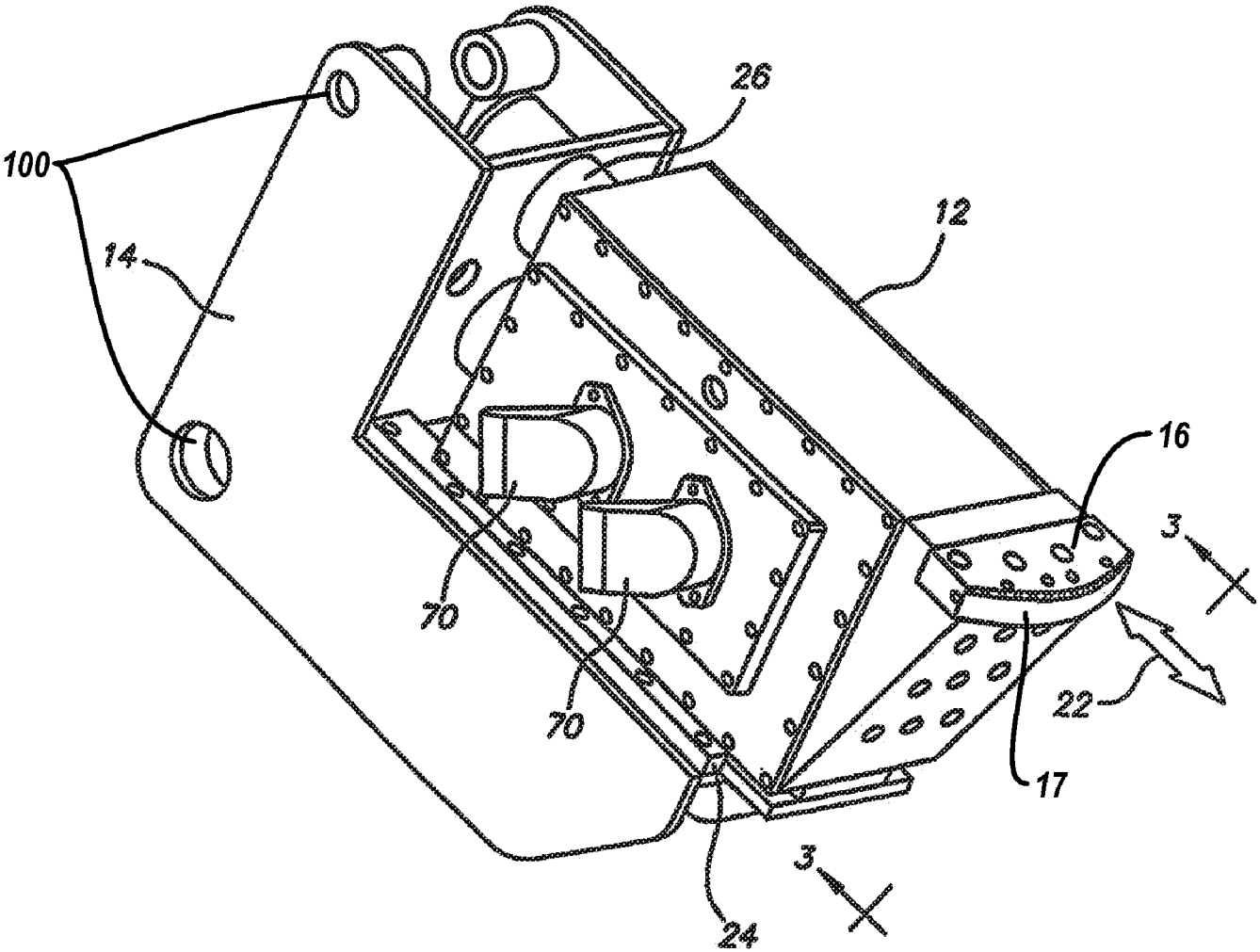
FIG. 2 is an isometric view of the vibratory milling machine of FIG. 1 removed from the support arm.
Figure 3:
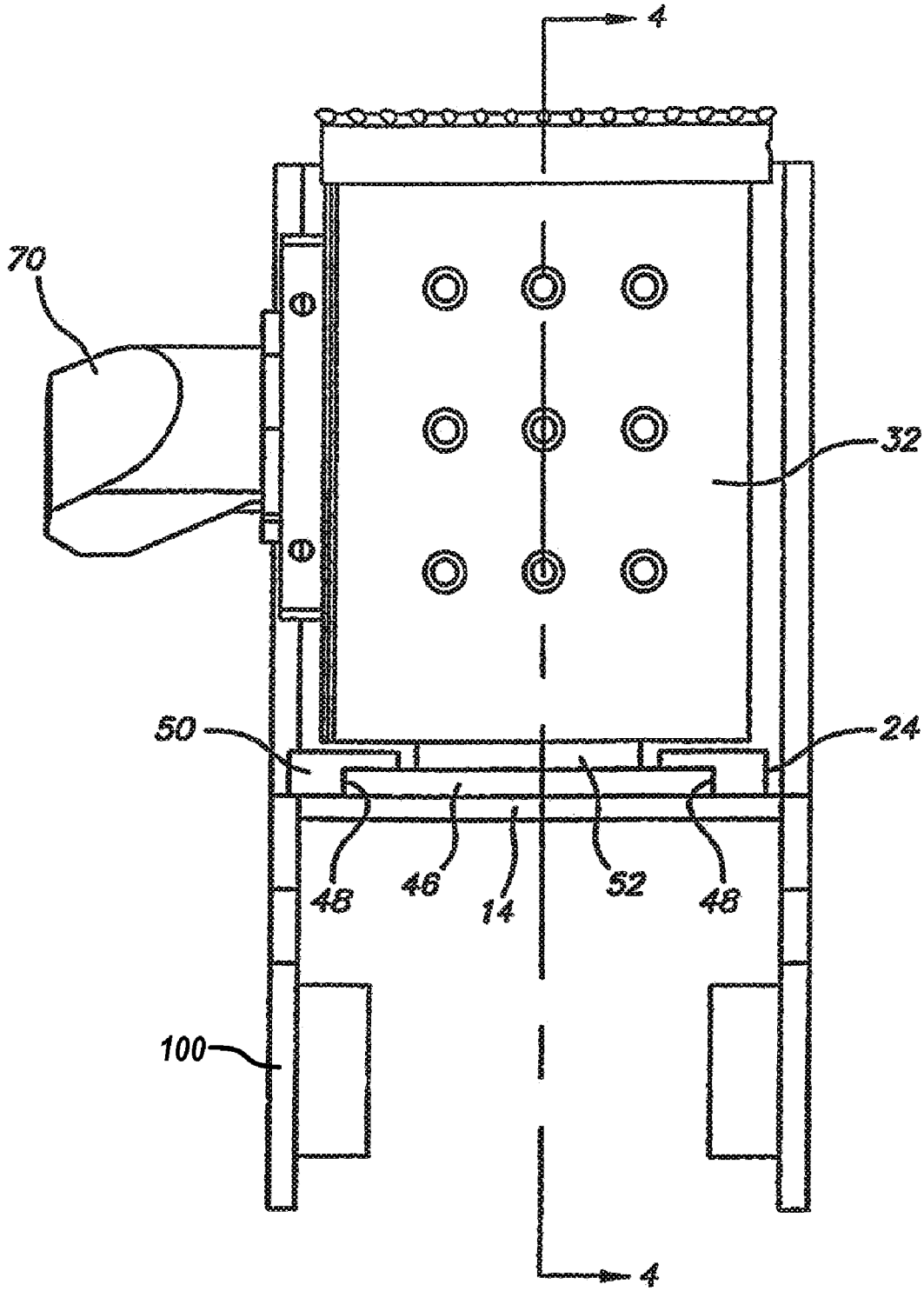
FIG. 3 is a front bottom plan view of the vibratory milling machine of FIG. 2.
Figure 4:
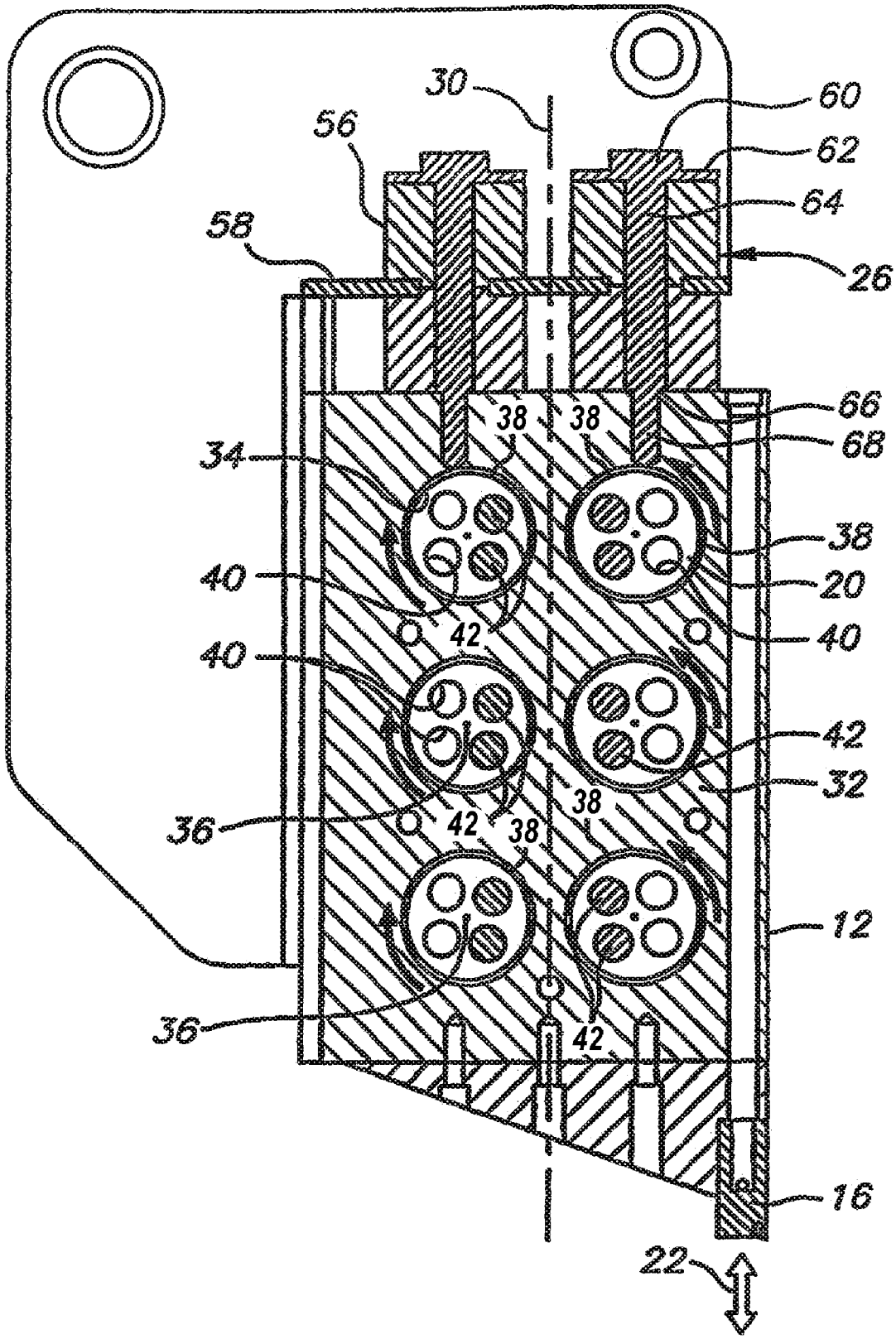
FIG. 4 is a cross-sectional view taken along the line 4-4 of FIG. 3.

As shown in FIG. 4, the milling head 12 is subjected to vibratory forces by rotors 20 arranged in pairs to rotate synchronously in opposing directions. In the illustrated example, a central plane 30 can pass longitudinally through the milling head 12. The rotors 20 are arrange in pairs on opposing lateral sides of the central plane 30 so that lateral oscillations cancel and longitudinal oscillations are reinforced. Accordingly, the rotors 20 can cause the milling head 12 to oscillate parallel to a milling axis or a milling plane. Accordingly, the milling axis 22 can be generally parallel to the central plane 30. As illustrated in FIGS. 2 and 3, movement of milling head 12 relative to base 14 is physically limited along axis 22 by slide mechanism 24. In addition, bumper system 26 is provided at the upper end of milling head 12 to limit milling head 12 to a relatively short pre-defined range of travel along the milling axis 22. While this reciprocating movement is substantially parallel to the milling axis 22, shaped milling tools or arrangements of multiple tools can be used in some embodiments to produce a shaped cut or provide advantageous angles of attack through certain materials.

Figure 8:
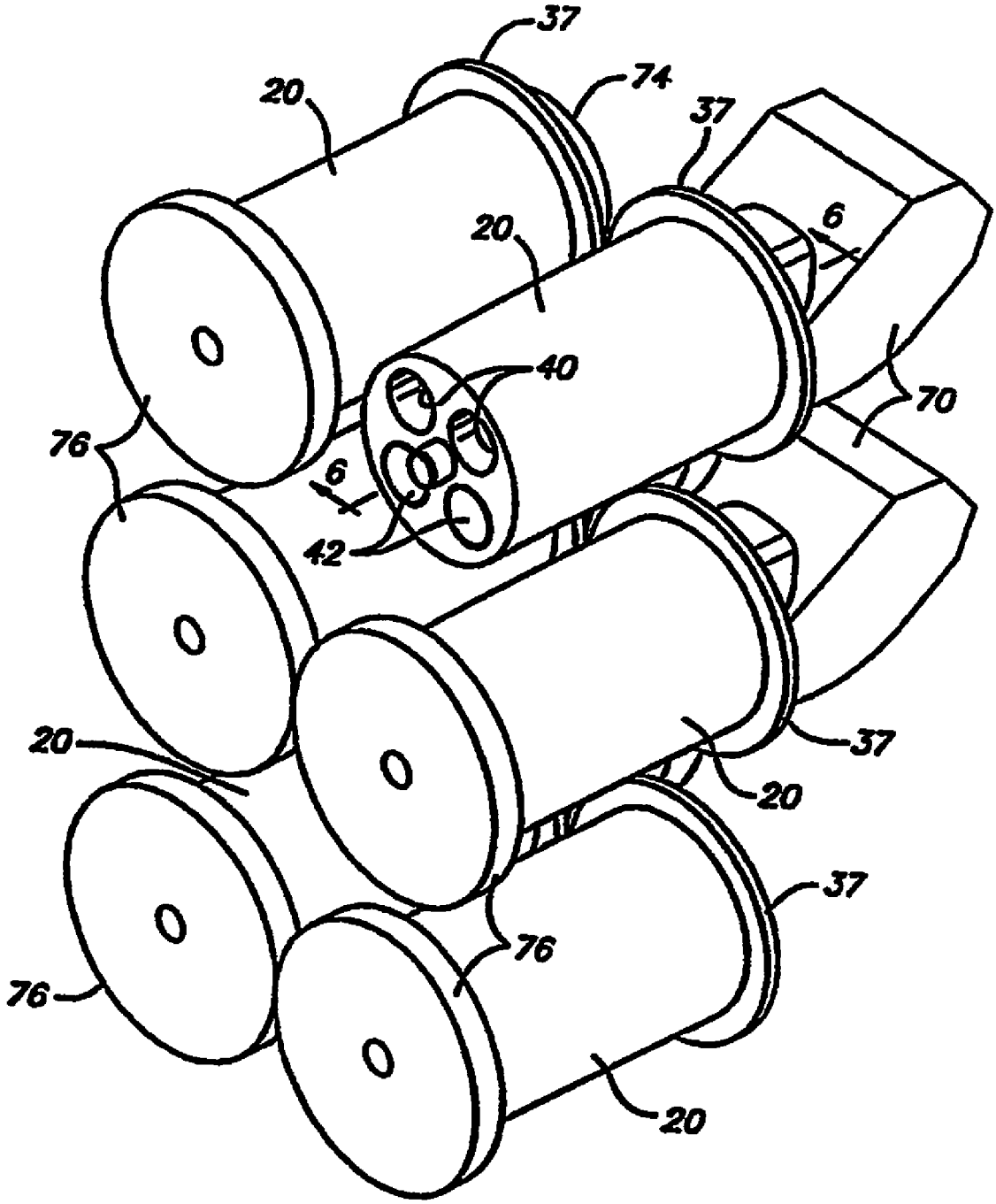
FIG. 8 is an isometric view of the rotors, gear trains and motors of the milling head of FIGS. 1-7.

As shown in the embodiments depicted in FIGS. 4 and 8, the milling head 12 in the illustrated embodiment has six rotors 20 arranged in three pairs which are disposed vertically relative to each other such that each pair of rotors has one rotor on either side of a central plane 30 extending vertically through the milling head 12. Each of the rotors 20 is mounted for rotation within a cylindrical recess 34 of a housing or "block" 32 about a corresponding primary axis 36. Each cylindrical recess 34 is lined with a pair of Babbitt-type bearing inserts 38 such that the outer cylindrical surface of the corresponding rotor 20 serves as a bearing journal. As described below, the bearings formed between the outer journal surfaces of the rotors 20 and the inner surfaces of the bearing inserts 38 are pressure-lubricated by oil or other suitable lubricant introduced radially inwardly through passages 39 (FIG. 9) within the housing 32 and between the bearing inserts 38, toward the outer journal surfaces of the rotors. The lubricant thus at least partially fills an annular space 41 between the outer journal surfaces of the rotors 20 and the inner surfaces of the bearing inserts 38, creating a hydro-dynamic journal bearing capable of withstanding the substantial vibrational forces created during operation of the milling machine 10. In addition, thrust washers 37 are provided at the ends of the rotors. These washers bear against outer ends of the bearing inserts which protrude (not shown) from the housing 32 to form thrust bearings for the rotors. In other embodiments, though, the oil can be introduced from the center of the roller (i.e., journal).

Vibrational forces are created by rotation of the rotors 20 due to the asymmetric weight distribution of each rotor about its primary axis 36. As illustrated in FIG. 4, each rotor has four length-wise openings 40 extending through it and arranged symmetrically about the axis 36 for reception of cylindrical weights 42. In the illustrated embodiments, two of the openings 40 of each rotor 20 are filled with cylindrical weights 42 and the other two openings are left empty. This causes each of the rotors 20 to be highly asymmetrical in mass, maximizing the vibrational force created by its rotation. The cylindrical weights 42 may be made of tungsten or other suitable material of high mass density.

As illustrated in FIG. 4, rotors 20 of each pair rotate in opposite directions about their parallel axes and the weights 42 are positioned in their openings 40 such that the heaviest portions of the two rotors rotate "in phase", with each pair of rotors being synchronized such that all six of the rotors are in phase with each other. Thus, the lateral perpendicular to the central plane 30) vibrational force created by one of the rotors 20 is precisely cancelled by an equal and opposite vibrational force created by the other rotor of the same pair. Lateral vibrations are neutralized in this way as the rotors 20 rotate synchronously within the housing 32, leaving only the longitudinal components of the vibrational forces to act on the main housing 32. This causes the vibrational forces of the milling head 12 to be channeled almost entirely into longitudinal forces coinciding with the milling axis 22, resulting in reciprocal movement of the milling head 12 relative to the base 14 by operation of the slide mechanism 24.

As shown in FIGS. 2 and 3, the slide mechanism 24 is made of a wear plate 46 that slides longitudinally along a pair of channels 48 formed by clamping bars 50 attached to the base 14. The wear plate 46 is attached to the housing 32 through a slide base 52. Thus, the slide mechanism 24 prevents undesirable lateral motion of the milling head 12 relative to the base 14 that might otherwise result from the high vibrational energy imparted to the milling head 12, and yet allows the milling head to move freely in the longitudinal direction 22, which can be the primary milling or mining direction.

The details of the bumper system 26, which maintains the milling head 12 within a prescribed range of motion relative to the base 14, are illustrated in FIG. 4. In the embodiments shown in FIG. 4, the bumper system 26 includes two pairs of bumpers 56 disposed on either side of a plate 58 of the base 14 such that respective bumper assembly bolts 60 extending downwardly through the bumpers and threaded into the main housing 32 serve to resiliently mount the main housing to the base. Each of the bumper assembly bolts has an integral washer-like flange 62 at its upper end and a shank portion 64 extending through the two washers and the plate 58 to a shoulder 66 and a reduced-diameter portion 68 which is threaded into the main housing 32. The bumper assembly bolts 60 are dimensioned to be threaded into the main housing 32 until they seat against the housing at the shoulders 66 to pre-compress the bumpers 56 by a preselected amount. Thus, the dimensions and make-up of the bumpers 56, as well as the dimensions of the bumper assembly bolt 60, can be modified to alter the spring constant and the extent of travel of the milling head 12 relative to the base 14.

In some embodiments, bumpers 56 may be air cushions. Assembly bolts 60 may be located externally of bumpers 56, allowing simple air cushions to be employed in bumper system 26. Bumpers 26 may be pre-selected with a particular stiffness depending on the power, weight, size and design of vibratory milling machine 10. For example, a larger, heavier milling head 12 may require stiffer bumpers 26 to absorb the shock of milling head 12 in motion. The stiffness in bumpers 26 may be determined by the size, material, and design of bumpers 26 to accommodate a particular operation as desired.

Figure 6:
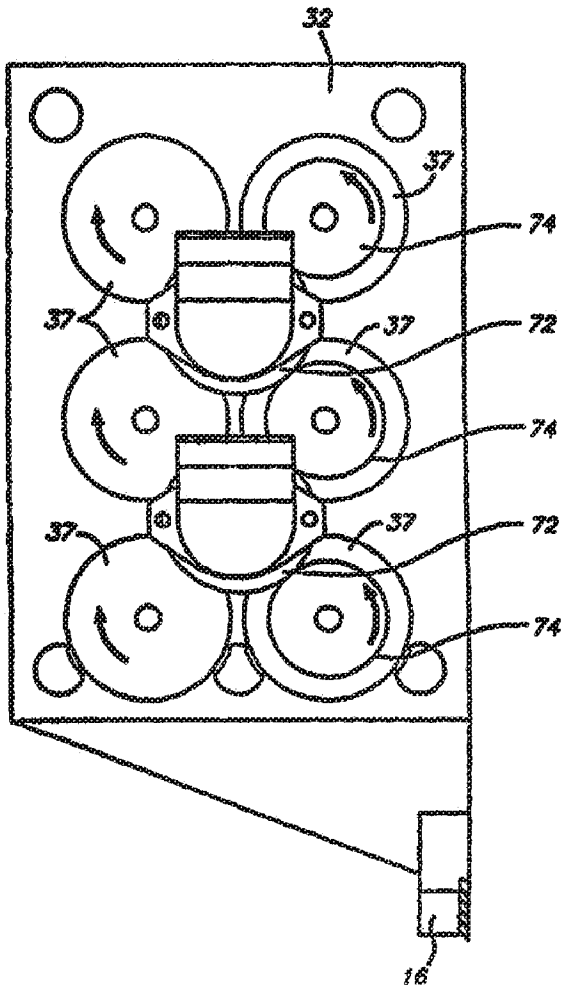
FIG. 6 is a left side elevational view of the milling head of FIG. 5 with the corresponding side cover removed to illustrate a gear train underneath.
Figure 5:
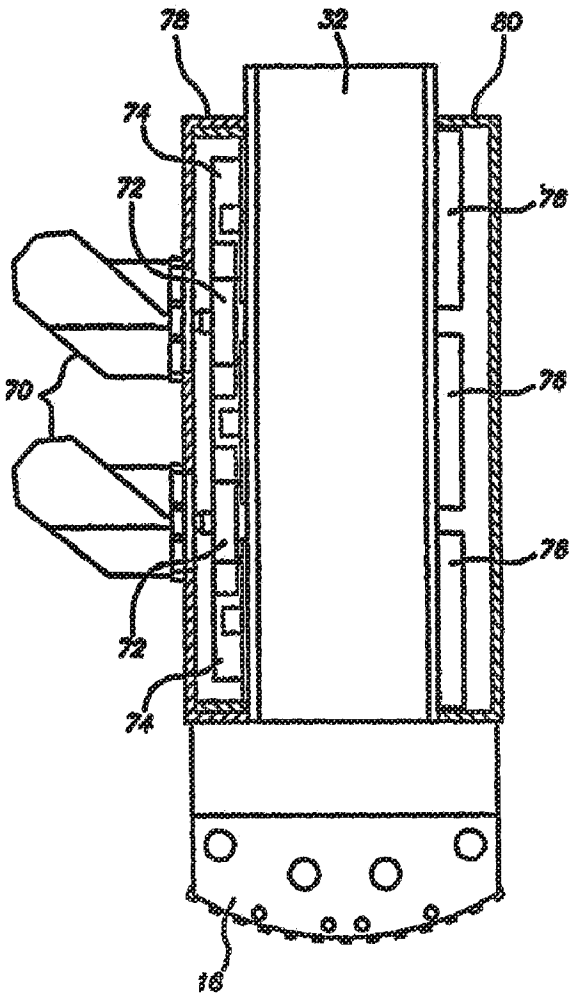
FIG. 5 is a front bottom elevational view of a milling head of the vibratory milling machine of FIG. 2, shown separated from its base and with a pair of side covers of the milling head broken away to show the gear trains underneath.
Figure 7:
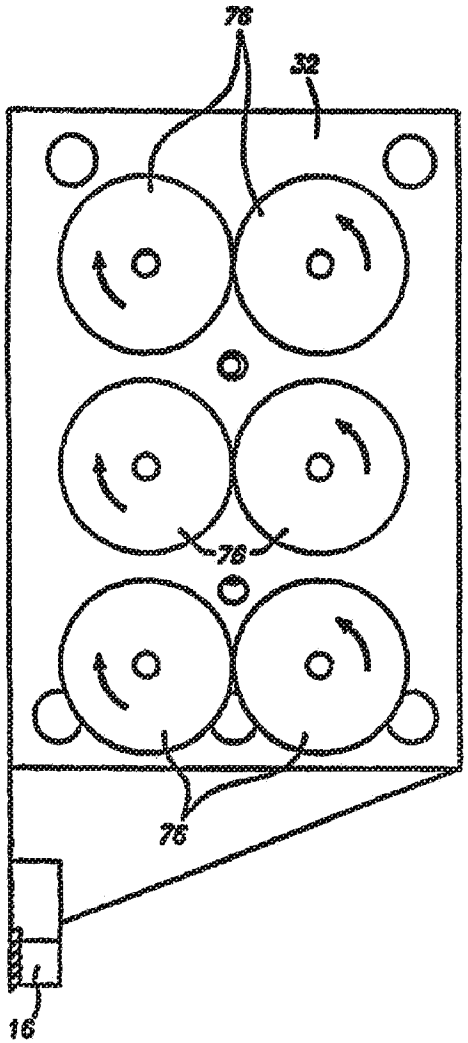
FIG. 7 is a right side elevational view of the milling head of FIG. 5 with the corresponding side cover removed to show the synchronizing gear train underneath.

The manner of synchronously driving the rotors 20 is seen most clearly in FIGS. 5-7, wherein a pair of motors 70 drive the three rotors on the right hand side of FIG. 6 through a pair of drive gears 72 on the output shafts of the motors which engage driven gears 74 carried by the rotors. Thus, for a clockwise rotation of the motors 70, as viewed in FIG. 6, the rotors on the right hand side of FIG. 6 will rotate in a counterclockwise direction. As seen in FIG. 7, timing gears 76 are carried at the other ends of each of the rotors 20 such that the timing gears 76 of each pair of rotors engage each other. This causes the non-driven row of rotors (i.e., the row of rotors on the left hand side of FIG. 6) to rotate in a direction opposite to the first row of rotors which are driven directly by the motors 70. Thus, the operation of the gears 72 and 74 on the motor side of the milling head 12, along with the timing gears 76 on the back side of the milling head 12, serve to synchronize all six of the rotors 20 such that they all rotate at the same speed and in the same phase with the two vertical rows of rotors rotating in opposite directions. Motors 70 may be hydraulic motors, drawing fluid from the fluid in milling head 12. Thus, the hydraulic fluid to drive motors 70 may be the lubricant circulating in milling head 12.

As seen in FIG. 5, a side cover 78 covers the gear train on the motor side of milling head 12, while a side cover 80 covers the timing gears 76 on the opposite side of milling head 12. These two covers protect the gear trains and keep them clean while at the same time containing lubricant circulating within milling head 12. In addition, a plurality of seals (not shown) may be provided on the motor side of each of the rotors to maintain lubricant pressure within the journal bearings. It will also be understood that additional bearings (not shown) may be provided at either end of the rotors 20 to facilitate their rotation relative to the main housing 32 when sufficient lubricant pressure is not available. However, the primary bearing function will nevertheless be served by the hydrodynamic journal bearings between the rotors and the main housing 32.

Figure 9:
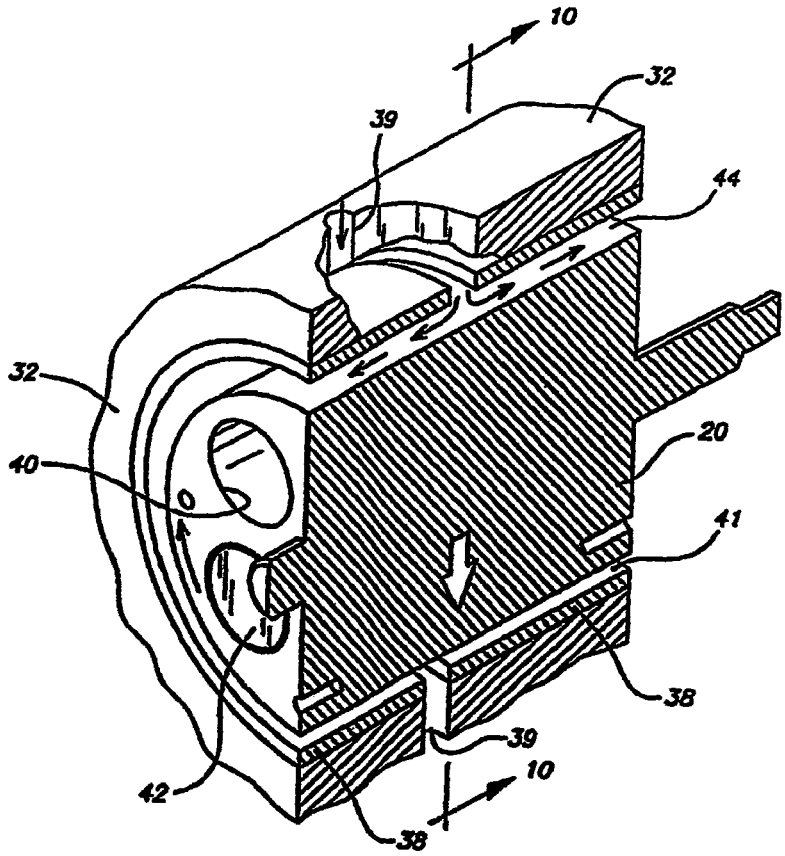
FIG. 9 is a diagrammatic vertical cross-sectional view of one of the rotors of FIG. 8 shown within a fragmentary portion of the housing, the clearances between the journal and the bearing being exaggerated to show the oil flow within the hydrodynamic journal bearing.
Figure 10:
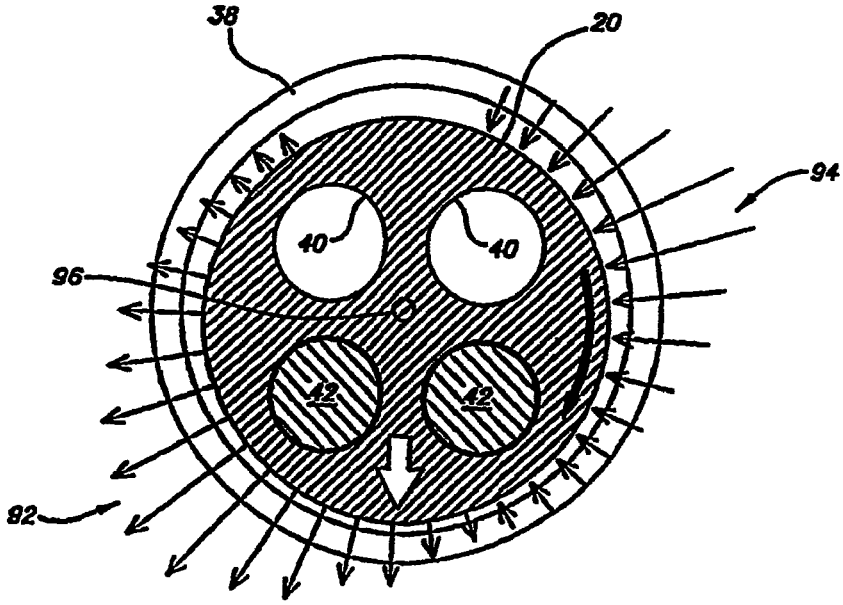
FIG. 10 is a diagrammatic view of the rotor of FIG. 9 showing in vector form the lubricant pressures within the bearing structure.
Figure 11A:
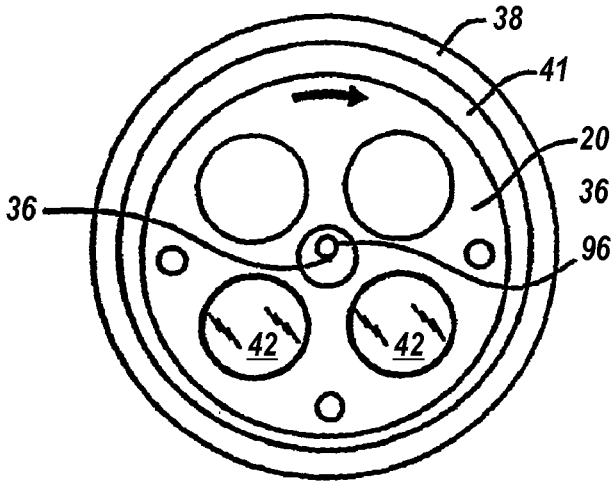
FIGS. 11A, 11B, 11C and 11D are sequential diagrammatic representations of the rotor of FIGS. 9 and 10 as it passes through one revolution of its rotational motion.
Figure 11B:
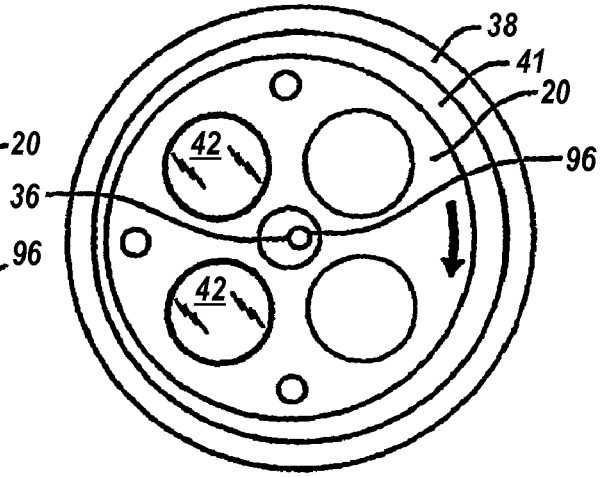
Figure 11C:
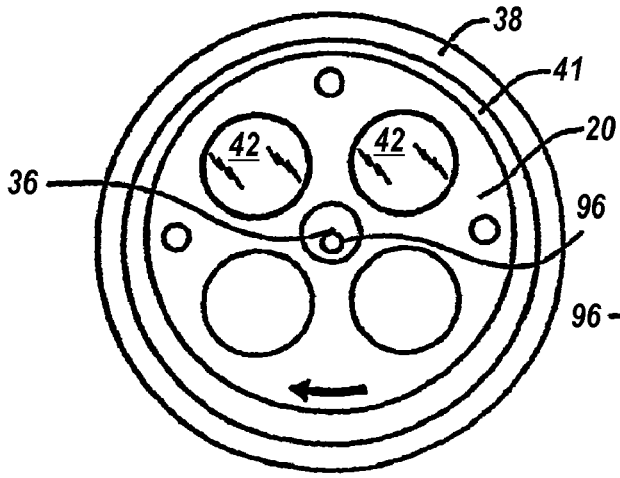
Figure 11D:
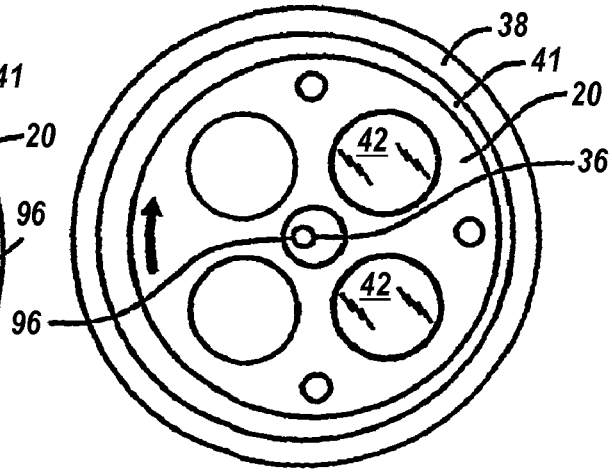

Turning now to FIGS. 9-11, the characteristics of the oil film between each of the rotors 20 and its corresponding bearing insert 38 are described in the operation of the hydrodynamic journal bearings and the useful life of the milling head 12. As shown in FIG. 9, in the illustrated embodiment, oil or other lubricant enters the cylindrical recess 34 of the housing 32 through the passages 39 and is conducted radially inwardly through a gap between the bearing inserts 38 to the space 41. The lubricant flows through the spaces 41, 44 in a direction parallel to the rotors 20, and ultimately out through the thrust bearings at the ends of the rotors.

The pressure of the lubricant between the rotor and the bearing insert is illustrated schematically in FIG. 10 for a clockwise rotation of the rotor. The outwardly directed arrows of the pressure distribution 92 indicate a high positive pressure of the lubricant, whereas the inwardly directed arrows of the pressure distribution 94 indicate low lubricant pressure. Thus, as the rotor rotates within the insert 38, lubricant "whirls" just ahead of the point of maximum centrifugal load, causing the interface between the rotor and the bearing insert to be well lubricated where the load is felt most acutely. This "whirl" is shown in FIGS. 11A, 11B, 11C and 11D, which together represent sequential points in a single rotation of the rotor.

In the course of rotation, the primary axis of the rotor moves about its original location, defining a small circle near the center line of the bearing insert. This path of the rotor's axis is illustrated at 96 in FIG. 10. In one embodiment, the diameter of this circle is on the order of 0.006 to 0.008 inches. Of course, all of the clearances between the journal surface of the rotor 20 and the internal surface of the bearing, as well as the path 96 followed by the geometric center of the rotor, are exaggerated in FIGS. 9-11 for clarity. In order to accommodate this motion of the rotors' geometric centers, the drive gears 72, the driven gears 74, and the timing gears 76 are provided with adequate backlash to permit the eccentric motion without binding.

The structures of the support arm 18 and the base 14 are illustrated most clearly in FIGS. 1-3, wherein the base 14 is illustrated as a heavy weldment made of high-strength steel able to withstand the extremely high forces created in automated milling operations. As illustrated in FIGS. 2 and 3, the base 14 is provided with a connection points 100 that may be used to receive a pivot pin or bolt to pivotally attach the base 14 and support arm 18 of a milling machine, back hoe, or other piece of excavating equipment (not shown) with which milling machine 10 may be used. Connection points 100 may also be coupled to actuator 104 that may be anchored to support arm 18. Thus, as the support arm is moved, the vibratory milling machine 10 can be moved to any desired location so that the milling tool 16 contacts the rock or other workpiece being machined. When it is desired to change the orientation of the milling machine relative to the support arm, the actuator 104 can be actuated. This places the operator in complete control of the orientation and use of milling machine 10. In some embodiments, connection points 100 may be in any location for effective coupling and manipulation by a milling machine or other machine used with vibratory milling machine 100.

The various elements of the milling machine 10 may be made of a wide variety of materials. In some embodiments, the base 14, the milling head 12, the rotors 20 and the clamping bars 15 are made of high-strength steel, while the wear plate 46 of the slide mechanism 24 would be of a softer, dissimilar material such as a bronze alloy, nylon or a suitable fluorocarbon polymer of the type marketed by DuPont under the trademark, Teflon. The babbet-type bearing inserts 38 may also be made of a variety of materials, however in one embodiment they are steel-backed bronze bearing inserts of the type used in the automotive industry. One such bearing insert is a steel-backed bushing marketed by Garlicky under the designation DP4 080DP056. These particular bushings have an inside diameter that varies between 5.0056 and 4.9998 inches. In this embodiment, due to the wide tolerance range, the rotors may be finished to the actual size required after the bushings are installed in the housing. The finish on the resulting outer cylindrical surface of the rotors 20 may also be given a texture, such as that of a honed cylindrical bore, to maximize bushing life and oil film thickness. The cylindrical weights 42 within the rotors 20 may be tungsten carbide or other suitable material having suitable weight and corrosion-resistance properties.

In other embodiments, the clearance between the rotor's outer surface and the inner surface of the bearing inserts is between 0.008 and 0.010 inches. The minimum calculated lubricant film thickness at 4500 revolutions per minute is then between 0.00179 and 0.00194 inches. Oil flow through each bearing may be 2.872 to 3.624 gallons per minute, for a total of 34.5 to 43.5 gallons per minute for the entire machine. Power loss per bearing at 4500 revolutions per minute is calculated as 9.579 to 9.792 horsepower or 115 to 118 horsepower total. Temperature rise through the bearings is then between 32 and 41 degrees Fahrenheit, for a total heat load of 4900 to 5000 BTU/minute from the bearings. Oil scavenge is through a 2.00 inch port (not shown) in one of the housing side covers 78 or 80. In some embodiments, one or more scavenge pumps are installed to drain the oil so that the milling head can work properly in any direction.

In still other embodiments, the hydraulic motors 70 and the various gear sets may be selected to cause the rotors to spin in a range of between 3000 and 6000 revolutions per minute. This corresponds to a frequency of movement of the milling head 12 between 50 and 100 hertz. Thus, in such embodiments, the milling tool 16 would be actuated at sonic frequencies against rock or other mineral deposits to machine material away in a mining operation. In some embodiments, the frequency of movement of the milling head 12 may be from between about 50 and about 150 Hz or higher, depending on the size, application, and frequency preferences of one of ordinary skill.

Figure 12:
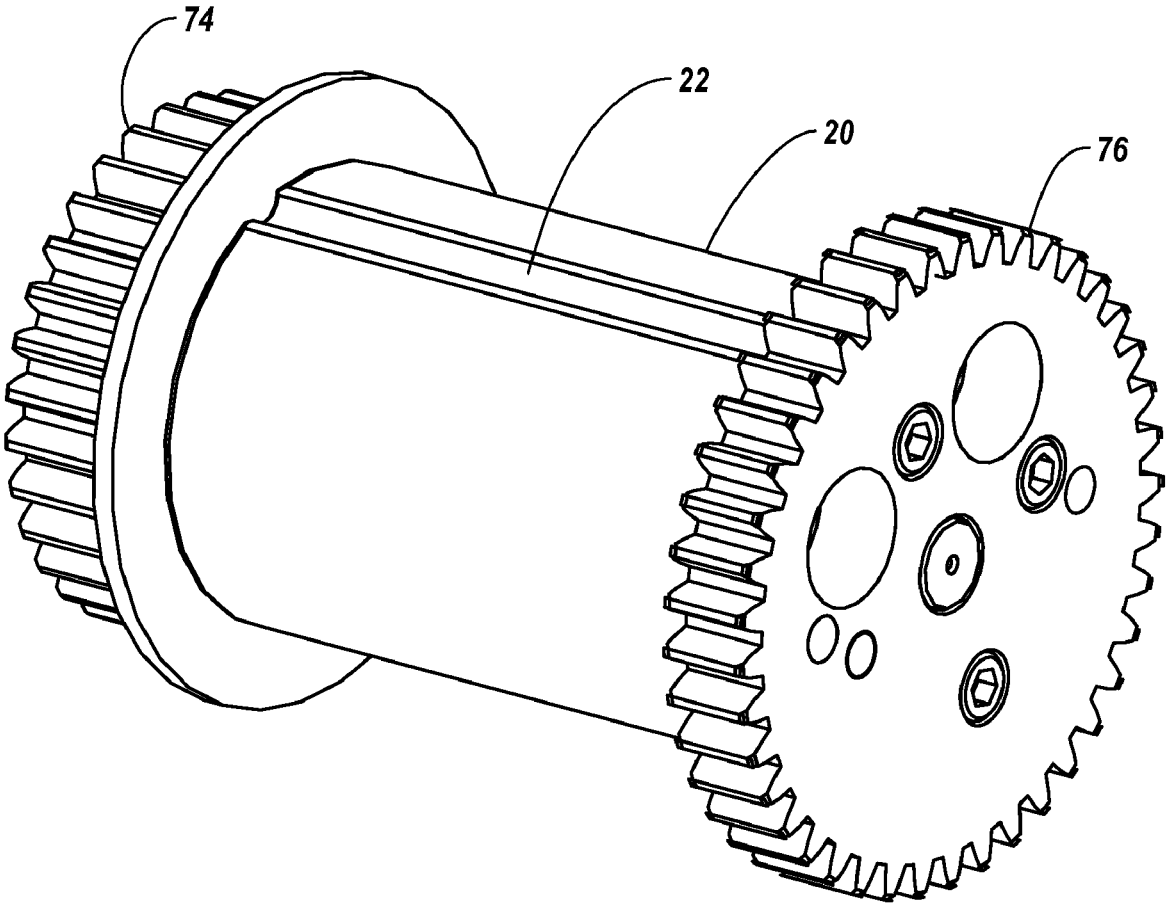
FIG. 12 is an isometric view of a rotor.

As shown in FIG. 12, rotors 20 may have a lubricant channel 22 to increase lubricant dispersion across the entire width of rotor 20. As rotor 20 rotates, lubricant collects in lubricant channel 22 and is dispersed in the cylinder in which it rotates. Lubricant channel 22 may be located on the lighter side of rotor 20. In some embodiments, the lubricant may be injected through rotor 20 and allowed to push outwardly through access holes (not shown). Similarly, the space between bearing inserts 38 may be minimized to allow lubricant coverage.

Figure 13:
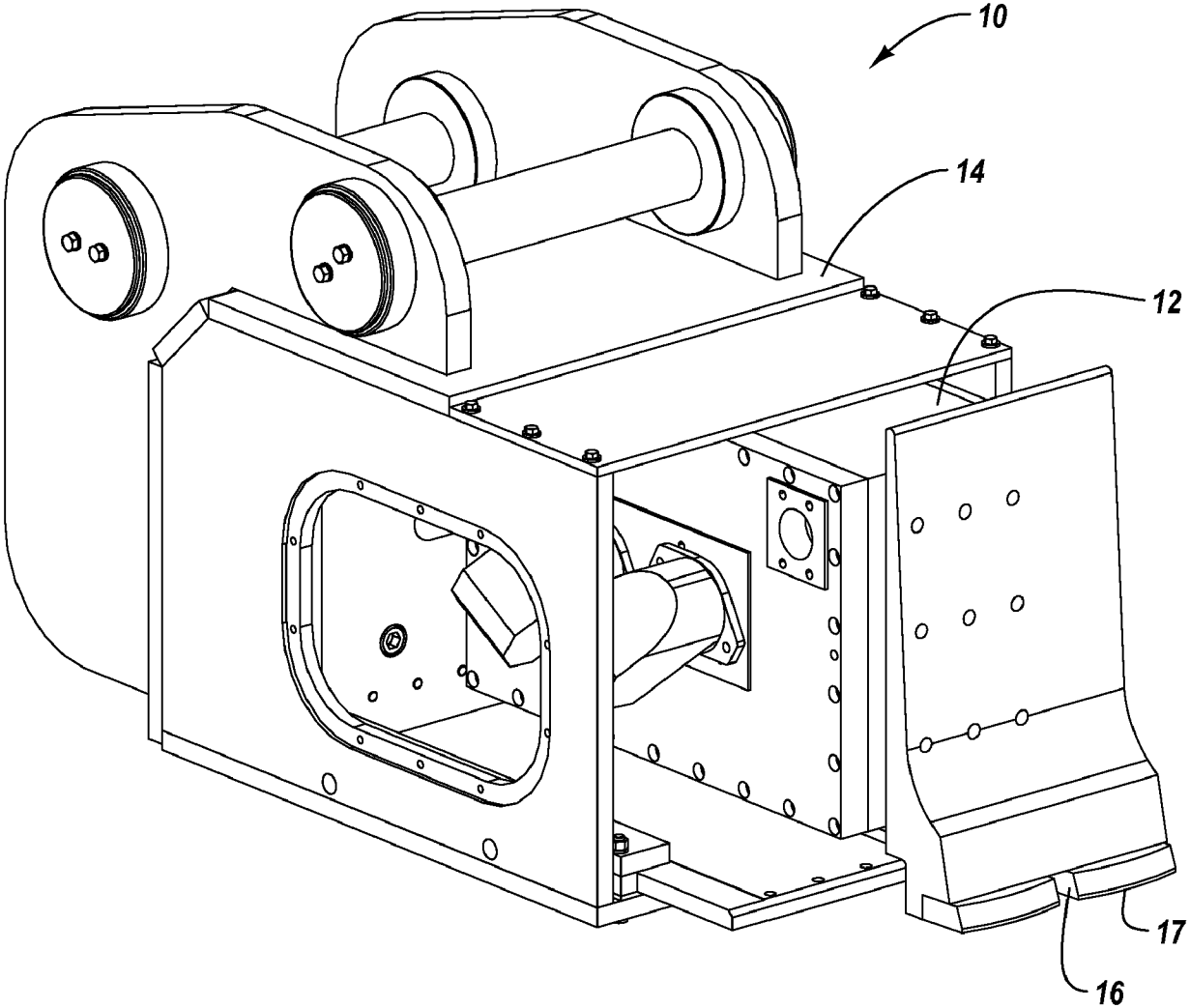
FIG. 13 is an isometric view of a vibratory milling machine.

In some embodiments, milling head 12 may be wider or narrower, depending on the desired application. For example, as shown in FIG. 13, milling head 12 may occupy only a portion of the width of base 14, while in FIGS. 14 and 15, milling head 12 is substantially the same width as base 14. In some applications, such as in mining hard rock, a narrower milling head 12 and milling tool 16 may be desired to apply greater force to a smaller area being impacted by cutting tools 17. Similarly, selection of the number of pairs of rotors 20 may be made depending on the desired size of milling head 12, the formation to be cut, and for other engineering considerations, such as to achieve greater force without raising the center of mass, thereby maintaining a minimum bending moment on the milling machine 10. Additionally, additional pairs of rollers 20 may allow for greater force per unit cutter length along cutting tools 17.

Figure 14:
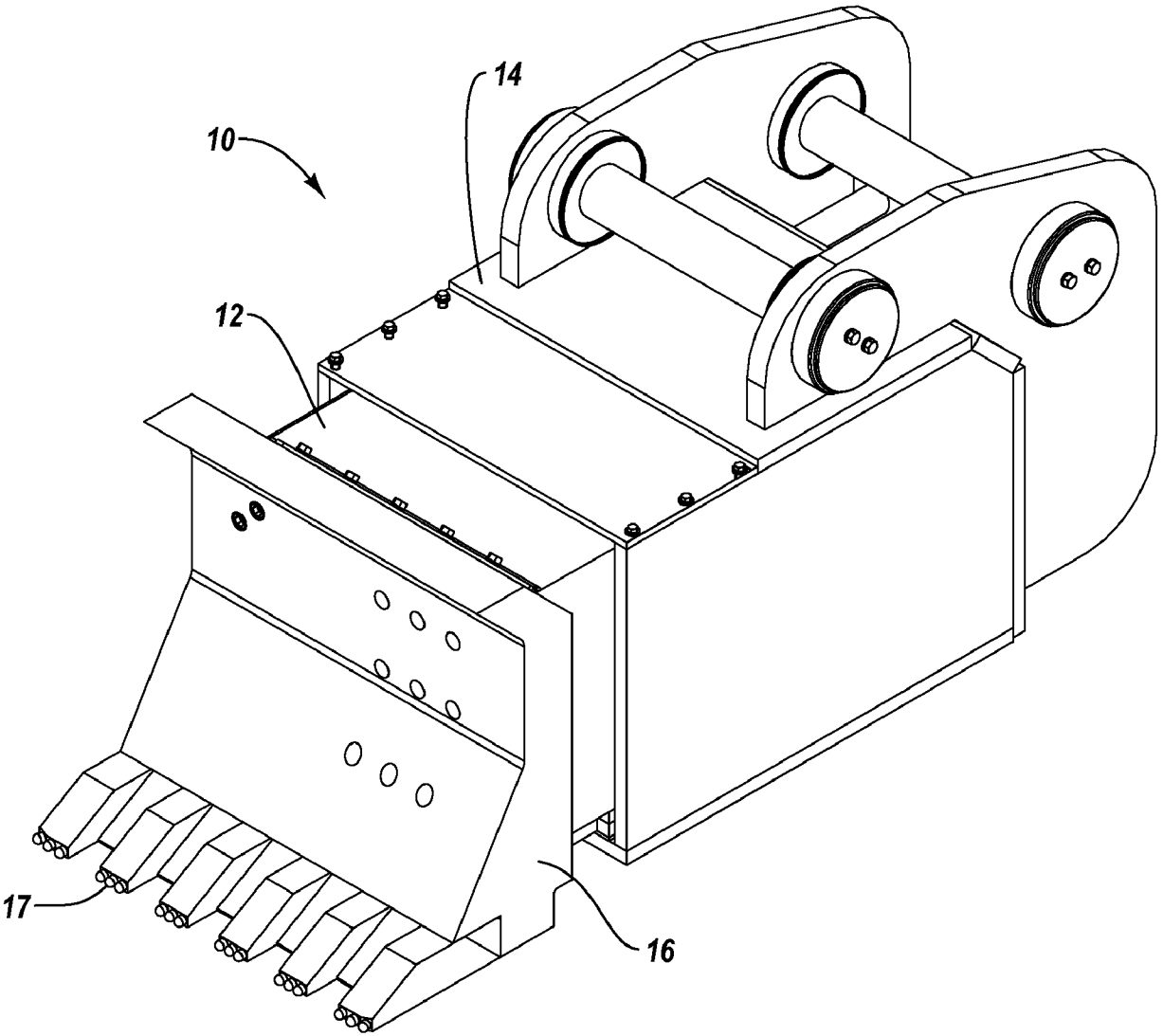
FIG. 14 is an isometric view of a vibratory milling machine.
Figure 15:
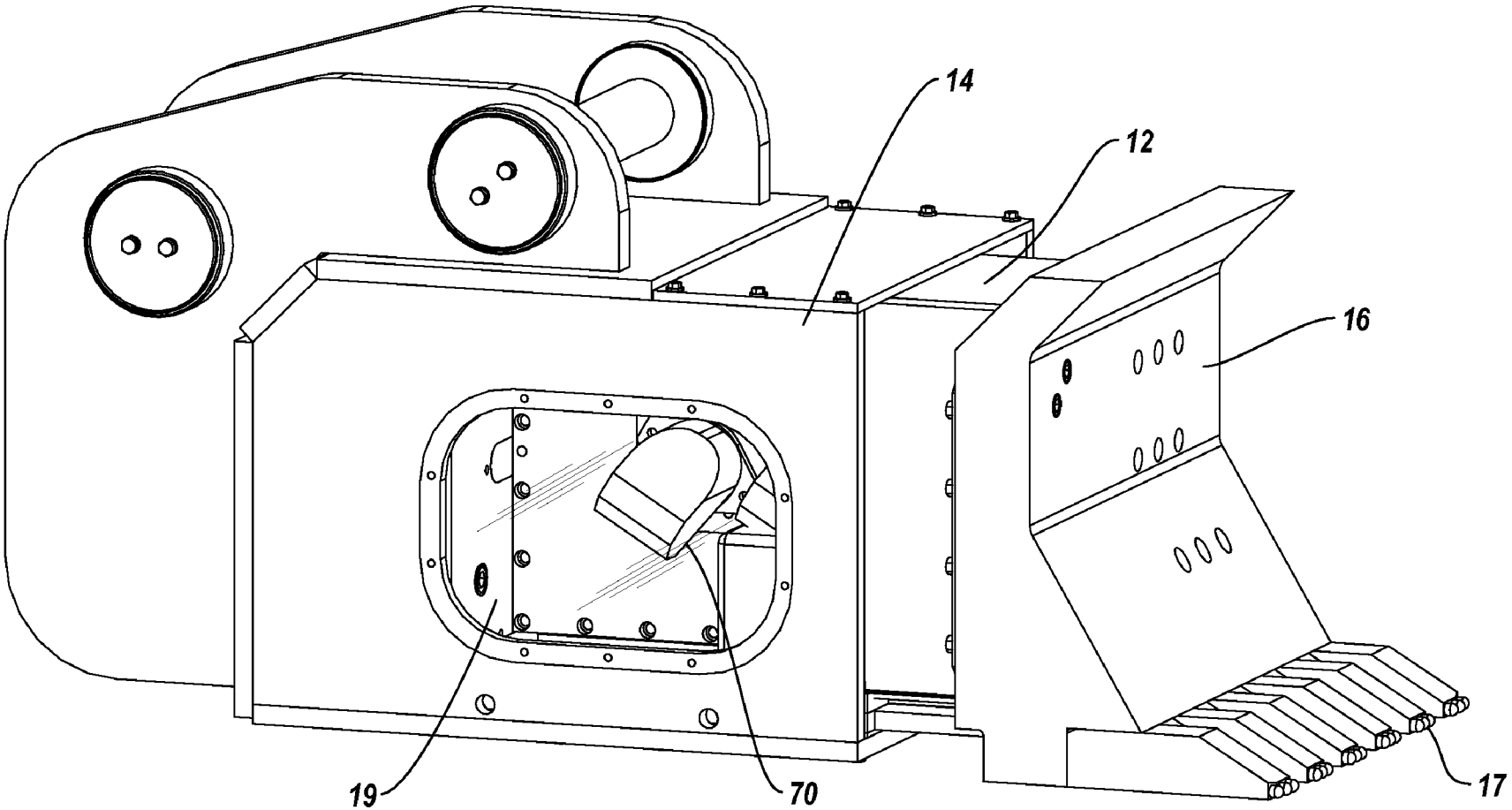
FIG. 15 is an isometric view of a vibratory milling machine.

The milling tool 16 can have a wide variety of configurations. As shown in FIGS. 14 and 15, milling tool 16 may be as large as possible to cut a maximum of material. For example, milling head 12, milling tool 16, and cutting tools 17 may be designed to mine between about 0.25" and about 5" or more from a formation with each pass, depending on preference, power in vibratory milling machine 10, and material to be cut.

Figure 16:
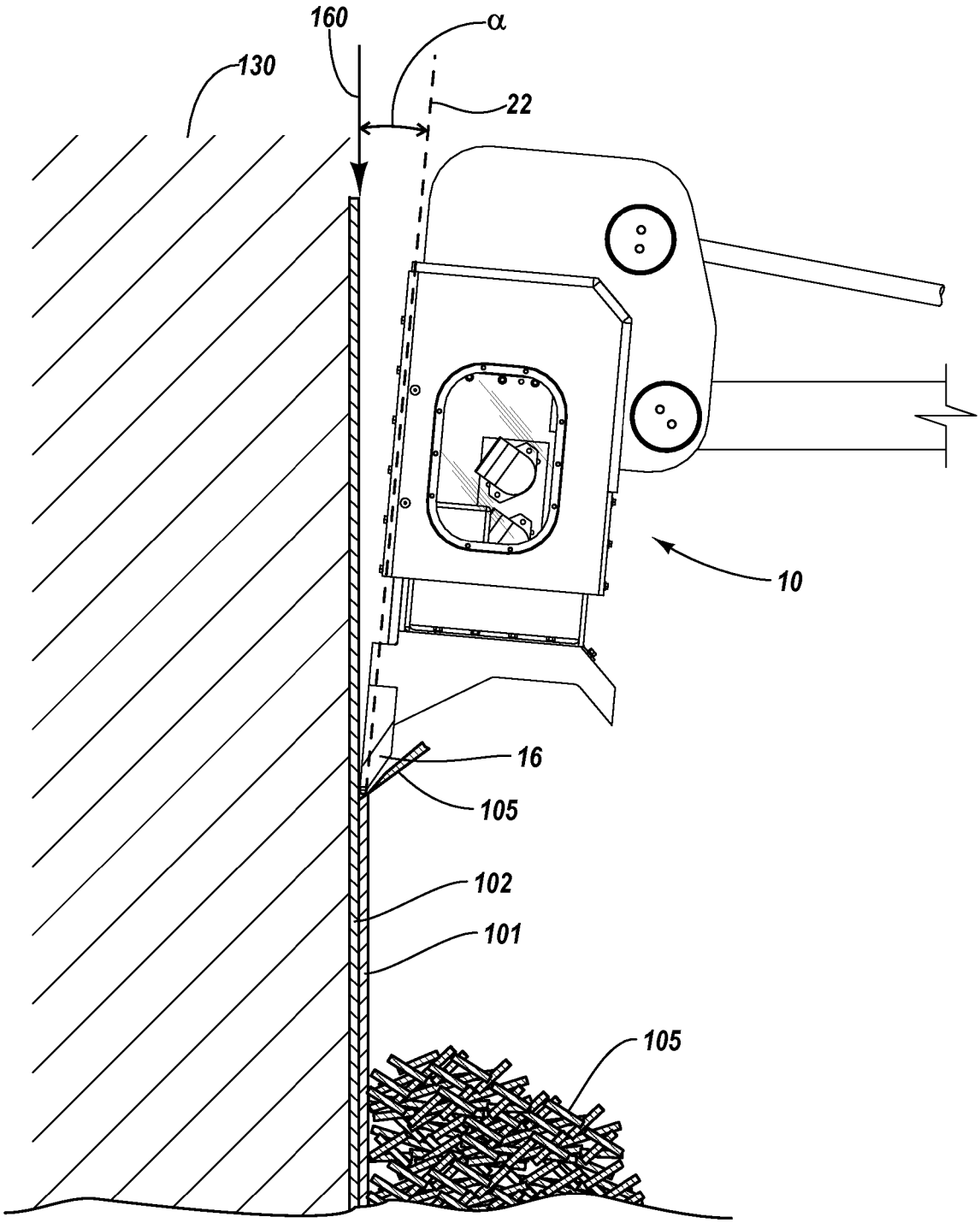
FIG. 16 is a schematic drawing of a vibratory milling machine removing layers of material from a formation.

The cutting tools 17 may be a variety of shapes, sizes and configurations. In some embodiments, the cutting tools 17 may include several teeth, such as is shown in FIGS. 16-17. Each of cutting tools 17 may include one or more cutting inserts. The number of cutting inserts can range such that the gap between two adjacent inserts may be between about 0.2 and 2.0 times the insert diameter. In other embodiments, though, the gap between two adjacent inserts may be between about 0.75 and 1.25. The top cutting edge of each insert may have any conventional shape, such as dome, ballistic and conical, chisel, etc. Inserts with different shapes may be combined in a single cutting tool 17 or may alternate between cutting tools 17. Additionally, each insert may be shaped as desired by one of ordinary skill depending on the desired use.

In some embodiments, one or more rounded cutting tools 17 may be used in order to reduce both the manufacturing and the operating cost, as shown in FIGS. 2, 13. Should an insert fail, only a small section needs replacement. Cutting tools 17 may be selected depending on the particular material to be machined, mined, and/or removed, the desired condition of removed material or the resulting milled face, or for any reason employed by one of ordinary skill, as different cutting tools 17 and milling tool 16 configurations may result in distinct resulting materials.

In some embodiments, base 14 may enclose milling head 12 to protect motors 70 and other components from damage. As shown in FIG. 14 includes access panel 19 to allow access to the interior of vibratory milling machine 10.

The vibratory milling machine 10 may be used to cut a workpiece or material formation layer by layer in a continuous milling action. In some embodiments, the milling action removes layers of material with substantially uniform thickness with each pass. In other embodiments, though, the material removed does not have to have a uniform thickness.

FIG. 16 also illustrates a continuous vibratory milling method according to one example. A step of continuous vibratory milling can include a preliminary step of advancing a tip of the milling tool 16 to a desired position and depth within a formation. This step can include operating the vibratory milling tool to cause the milling tool to longitudinally reciprocate parallel to the milling axis 22 to move the milling tool 16 to a desired depth. In at least one example, the milling tool 16 can be advanced to a depth of between about 0.5 inches or less to about three inches or more. For example, the milling tool 16 can be advanced to a depth of between about 1.5 inches to about 2.5 inches. The milling tool 16 can be moved to a desired orientation either before or after the milling tool 16 is moved to a desired depth. The milling tool 16 can then be operated and advanced to remove material from a formation, as will be described in more detail below.

As illustrated in FIG. 16, the method can include advancing the vibratory milling machine 10 in a cutting direction shown by arrow 160. As the milling tool 15 oscillates along the milling axis 22 while being advanced in the cutting direction, the vibratory milling machine 10 cuts a layer of material by applying tensile forces to the formation. In at least one example, advancing the vibratory milling machine 10 in the cutting direction 160 can include moving the vibratory milling machine 10 along a linear cutting path. In other examples, advancing the vibratory milling machine 10 in a cutting direction can include moving the vibratory milling machine 10 along a generally arcuate cutting path. In still other examples, advancing the vibratory milling machine 10 in a cutting direction can include moving the vibratory milling machine 10 along an irregular cutting path. In at least one of these examples, the cutting path can be substantially parallel to a surface of the formation being milled. Such a configuration can allow the vibratory milling machine 10 to remove a layer of material having a substantially uniform thickness.

To maintain a substantially uniform thickness of material removed, the vibratory milling machine 10 may be supported such that milling tool 16 maintains a consistent angle between the milling axis 22 and the cutting direction 160. The angle between the milling axis 22 and the cutting direction 160 can be referred to as an attack angle $\alpha$. As previously introduced, the milling axis 22 can be generally parallel to the central plane 30 (FIG. 4). Accordingly, in at least one example, a method for continuous vibratory milling can include moving the vibratory milling machine 10 in a cutting direction while maintaining a constant angle of attack $\alpha$. In at least one example, the angle of attack $\alpha$ can be between about 0 degrees to about 40 degrees. The angle of attack $\alpha$ can be varied to suit the type of material within the formation to be shaved. For example, in a process where relatively soft material is being cut, the angle of attack can be toward the large end while in a process in which extremely hard material is being cut, the angle of attack can be smaller.

Thus, the vibratory milling machine 10 may be used to peel or shave away layer of a desired material on a continuous or semi-continuous basis. The vibratory milling machine 10, however, can be used to successively mill layer after layer of a desired formation. For example, as shown in FIG. 16, the vibratory milling machine 10 can continuously mine into a formation by shaving off a first layer 101 (thereby creating cut material 105), then an underlying second layer 102, then additional layers in the underlying material 103, and so on until the desired depth in the formation, or until the desired amount of material is reached. There is no need to stop the mining process since cut material 105 may be removed quickly, and may be easily disposed of while vibratory milling machine 10 continues to operate. For example, a milling machine may carry vibratory milling machine 10 and be configured to remove cut material 105 in a continuous process.

In some embodiments, any number of vibratory milling machines 10 may be used on a single piece of equipment (i.e., excavator) by using multiple support arms. Using multiple milling machines on a single piece of equipment allows multiple milling actions to occur in one work area, either synchronously or asynchronously. For example, one vibratory milling machine 10 on an excavator may cut horizontally on a floor or ceiling surface while another vibratory milling machine 10 on the same excavator may cut vertically on a facing wall. In other example, a large rotary array on a tunnel boring machine could contain multiple milling machines.

In other embodiments, a vibratory milling machine 10 can be used as well as the traditional mining and/or construction tools on the equipment. For example, there could be an array of milling heads or milling tools arranged in progressive planes or layers, i.e., stationary planning. And in yet other embodiments, the milling machine may be used in conjunction with drill-and-blast processes to efficiently level and clean exposed blast surfaces, improving the safety and facilitating the next round drilling.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. For example, the hydro-dynamic journal bearings can be replaced by mechanical bearings such as packed or permanently lubricated ball or roller bearings, if desired. Likewise, the frequency of operation and the physical arrangement of the rotors can be altered depending on the end use being addressed. Also, as used herein, examples are meant to be illustrative only and should not be construed to be limiting in any manner.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A continuous mining method, comprising:

operating a vibratory milling machine having a base, a milling head positioned within a recess of the base, and a milling tool to oscillate the milling head in a linear reciprocating fashion relative to the base to move the milling tool along a milling axis;

advancing the vibratory milling machine in a work piece in a cutting direction, wherein the milling axis is oriented at an attack angle relative to the cutting direction, the attack angle being between about 0 and about 40 degrees; and adjusting the angle of attack.

2. The method of claim 1, wherein operating the vibratory milling machine includes rotating at least two eccentrically weighted rotors positioned within a housing having at least a first end and a second end, the at least two rotors being mounted within the housing and adapted for rotation relative to the housing substantially about respective primary axes, each of the rotors having a asymmetrical weight distribution about its primary axis for imparting vibratory forces to the housing as the rotor rotates.

3. The method of claim 2, further including operating a drive structure for rotationally driving the rotors.

4. The method of claim 2, wherein rotating the rotors includes rotating at least one pair of said rotors positioned side-by-side in the housing with their primary axes on opposite sides of a central plane.

5. The method of claim 4, wherein the rotors of each pair are synchronized with one another and rotate in phase and in opposite directions about their primary axes.

6. The method of claim 2, wherein rotating the rotors includes rotating a plurality of pairs of rotors positioned with primary axes of each pair disposed on opposite sides of a central plane.

7. The method of claim 2, further comprising rotating the rotors on pressurized fluid located between the rotors and the housing.

8. The method of claim 1, further comprising resiliently countering movement of the milling head toward the base as the milling head as the milling head oscillates.

9. The method of claim 8, wherein resiliently countering movement of the milling head toward the base includes compressing air cushions positioned at least partially between the milling head and the base.

10. The method of claim 8, wherein resiliently countering movement of the milling head toward the base includes compressing elastomeric bumpers positioned at least partially between the milling head and the base.

11. The method of claim 1, wherein advancing the vibratory milling machine includes advancing the vibratory milling machine substantially parallel to a workpiece surface.

12. The method of claim 1, wherein advancing the vibratory milling machine includes advancing the vibratory milling machine at a depth relative to a workpiece surface of between about 1.5 inches to about 2.5 inches.

13. The method of claim 1, wherein the milling head oscillates at a frequency of between about 50 Hz to about 150 Hz.

14. The method of claim 1, wherein the milling head is narrower than the base.

15. The method of claim 1, wherein the milling tool is narrower than the base.

16. The method of claim 1, wherein the milling tool is narrower than the milling head.

17. In a vibratory milling machine having a milling tool carried on a vibratory housing, the method of milling comprising:

moving the milling tool in a substantially linear reciprocating manner along a milling axis by rotating at least two eccentrically weighted rotors within the housing to create vibratory forces, wherein the housing is resiliently secured to a supporting base;

confining the housing to move in a substantially linear direction along a pair of channels of the supporting base; and advancing the vibratory milling machine in a cutting direction while moving the milling tool in a linear reciprocating manner along the milling axis in which the milling axis is disposed at an attack angle relative to the cutting direction, the attack angle being between about 0 degrees and about 40 degrees.

18. The method of claim 17, including moving the milling tool in a substantially linear reciprocating manner at a frequency of between about 50 Hz to about 150 Hz.

19. The method of claim 17, wherein rotating at least two eccentrically weighted rotors comprising counter-rotating at least one pair of rotors disposed on opposite sides of a central plain containing a milling axis.

20. The method of claim 17, wherein the attack angle is maintained less than about 40 degrees.

* * * * *